United States Patent [19]

Lohmann et al.

[11] 4,186,016

[45] Jan. 29, 1980

[54] COLOR PHOTOGRAPHIC RECORDING MATERIAL

[75] Inventors: Joachim W. Lohmann, Kuerten; Otto Lapp, Leverkusen; Immo Boie, Cologne, all of Fed. Rep. of Germany

[73] Assignee: Agfa-Gevaert Aktiengesellschaft, Fed. Rep. of Germany

[21] Appl. No.: 797,753

[22] Filed: May 17, 1977

[30] Foreign Application Priority Data

May 21, 1976 [DE] Fed. Rep. of Germany ..... 2622923

[51] Int. Cl.[2] ..... G03C 1/76; G03C 3/00

[52] U.S. Cl. ..... 430/506; 430/507

[58] Field of Search ..... 96/74, 88, 68, 9, 10

[56] References Cited

U.S. PATENT DOCUMENTS 3,663,228 5/1972 Wyckoff ..... 96/74

3,932,185 1/1976 Matsuura ..... 96/74

FOREIGN PATENT DOCUMENTS 2530645 1/1976 Fed. Rep. of Germany ..... 96/74

*Primary Examiner*—J. Travis Brown

*Assistant Examiner*—Louis Falasco

*Attorney, Agent, or Firm*—Connolly & Hutz

[57] ABSTRACT

In a color photographic material comprising a plurality of light-sensitive and non light-sensitive layers including at least two red sensitive coupler-containing silver halide emulsion layers of different speed, at least two green sensitive coupler-containing silver halide emulsion layers of different speed and a blue sensitive coupler-containing silver halide emulsion layer as well as a yellow filter layer located closer to the support than the blue sensitive silver halide emulsion layer but further removed from the support than any of the red sensitive or green sensitive layers, the sensitivity of the cyan partial image is significantly improved if the more sensitive red sensitive together with the more sensitive green sensitive silver halide emulsion layer forms a comparatively more sensitive emulsion layer unit which is located further removed from the support than a corresponding comparatively less sensitive emulsion layer unit formed by the less sensitive green sensitive and the less sensitive red sensitive silver halide emulsion layer, and the uppermost silver halide emulsion layer within the comparatively less sensitive emulsion layer unit is sensitive to the same spectral region as the lowermost silver halide emulsion layer within the comparatively more sensitive emulsion layer unit.

4 Claims, 1 Drawing Figure

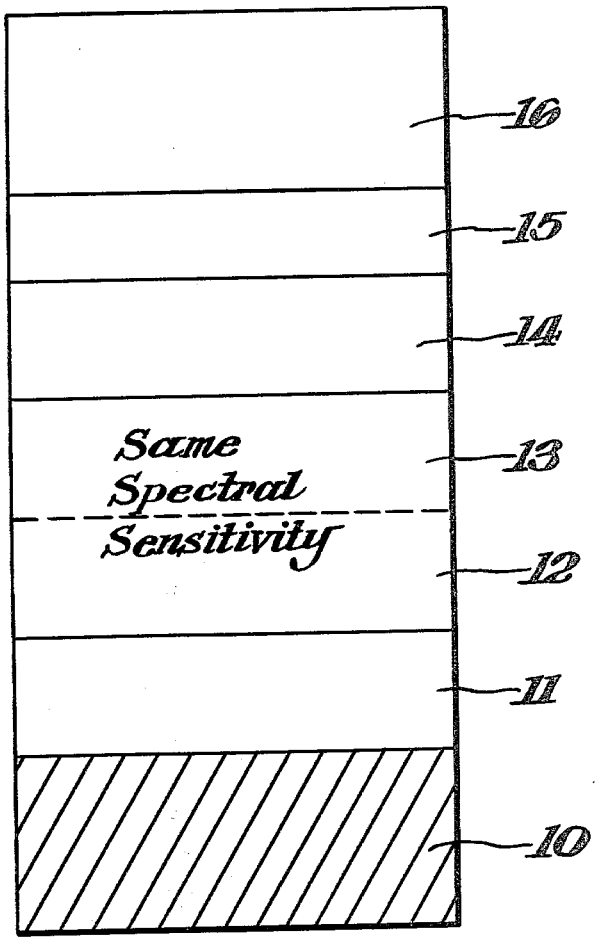
16
15
14
Same
Spectral
Sensitivity
13
12
11
10

COLOR PHOTOGRAPHIC RECORDING MATERIAL

This invention relates to a colour photographic recording material comprising several silver halide emulsion layers, at least two of which contribute to the production of the cyan partial colour image and at least two others to the production of the magenta partial colour image, and in which improved sensitivity of the cyan partial colour image is achieved by a special arrangement of the layers.

For the production of coloured photographic images, it is known to use recording materials which have one red-sensitive, one green-sensitive and one blue-sensitive silver halide emulsion layer mounted on a substrate, each of the said silver halide emulsion layers having associated with it non-diffusible colour couplers for producing the cyan, magenta and yellow partial colour image, respectively, the colour of the partial colour image produced being in each case complementary to the spectral sensitivity of the associated silver halide emulsion layer. The usual colour photographic materials contain, in addition, other layers such as, for example, a yellow filter layer between the uppermost blue-sensitive silver halide emulsion layer and the green sensitive silver halide emulsion layer below it and an anti-halation layer between the substrate and the lowermost silver halide emulsion layer. Intermediate gelatine layers and a covering layer may also be provided.

For the production of colour photographic images, it is also known to use recording materials in which at least two silver halide emulsion layers are provided for the production of each of one or more of the three partial colour images. Thus, according to British Pat. No. 818,687, the lowermost light-sensitive, colour producing layer unit of a colour photographic multilayered material consists of two partial colour layers sensitized to light of the same spectral region and containing silver halide and colour couplers, the upper of the two partial layers having the greater sensitivity. German Pat. Specification No. 1,121,470 discloses the use of such double layers of differing sensitivities to light of the same spectral region in which the more sensitive of the two partial layers produces the lower colour density on colour development. This makes it possible to increase the sensitivity without at the same time producing a deleterious effect on the graininess.

Colour photographic recording materials having double layers for the various spectral regions have also been disclosed in U.S. Pat. No. 3,663,228 and 3,849,138. Here again, the upper of the two partial layers which are sensitive to light of the same spectral region has the higher sensitivity. The layer combinations described in these specifications, however, serve mainly to increase the exposure latitude and there is no mention of any increase in sensitivity. FIG. 1c of these two U.S. Patent Specifications shows a material containing two laminates which are separated from each other by a neutral grey filter, each of these laminates consisting of a red sensitive, a green sensitive and a blue sensitive silver halide emulsion layer.

In this case, therefore, the two partial layers which are sensitive to light of the same spectral region but differ in their sensitivity (speed) are not adjacent to each other but situated in different laminates which differ in their general sensititivity (speed) while each laminate contains several silver halide emulsion layers which differ in their spectral sensitivity but have a comparable general sensitivity. Partial layers of the same spectral sensitivity are in each case separated from each other by several layers of differing spectral sensitivity and by the grey filter. A similar arrangement which also provides a wider exposure latitude but uses colour filters has been disclosed in U.S. Defensive publication T 860,004.

German Offenlegungsschriften No. 2,453,654 and 2,453,664 describe arrangements of layers in which the red sensitive and/or green-sensitive partial layers are arranged above the blue-sensitive silver halide emulsion layer in order to increase the sharpness of the image. These arrangements, however, are inferior in their colour reproduction and such material should therefore only be used with certain sources of light such as tungsten light.

Finally, an arrangement of layers for improving the sensitivity has been disclosed in German Offenlegungsschrift No. 2,530,645, in which 1. the more sensitive of the two green-sensitive silver halide emulsion layers and the more sensitive of the two red-sensitive silver halide emulsion layers are arranged adjacent to each other in a comparatively more sensitive emulsion layer unit;
2. the less sensitive of the two green-sensitive silver halide emulsion layers and the less sensitive of the two red-sensitive silver halide emulsion layers are arranged adjacent to each other in a comparatively less sensitive emulsion layer unit;
3. the less sensitive emulsion layer unit is closer to the substrate than the more sensitive emulsion layer unit;
4. in each of the two emulsion layer units, the red-sensitive emulsion layer is situated closer to the layer substrate than the green-sensitive emulsion layer and
5. the less sensitive green-sensitive silver halide emulsion layer is adjacent to the more sensitive red-sensitive silver halide emulsion layer.

This material, therefore, also has two or more laminates of differing general sensitivity (different speed) and there is an alternating sequence of red-sensitive and green-sensitive silver halide emulsion layers. This arrangement necessarily comprises a relatively large number of interfaces between red-sensitive and green-sensitive layers so that a correspondingly large number of intermediate layers is necessary to prevent undesired co-coupling between layers. This entails a considerable increase in expense in the preparation of such materials.

It is an object of the present invention to provide a colour photographic recording material having several silver halide emulsion layers sensitized to different regions of the spectrum, which material is improved by comparison with known colour photographic materials in the sensitivity of the red sensitive silver halide emulsion layers.

The present invention relates to a colour photographic recording material consisting of (a) a substrate, (b) applied to this substrate, differently sensitized silver halide emulsion layers containing non-diffusible colour couplers, at least two of the said silver halide emulsion layers being sensitive to red light and differing from each other in their sensitivity (speed), at least two other silver halide emulsion layers being sensitive to green light and differing from each other in sensitivity, the more sensitive of each the red-sensitive and green-sensitive silver halide emulsion layers being situated further away from the substrate than the corresponding less sensitive silver halide emulsion layer, and at least one of the silver halide emulsion layers, and at least blue light, each blue-sensitive layer being further removed from the substrate than any of the red-sensitive or green-sensitive silver halide emulsion layers, and (c) at least one yellow filter layer, which is situated closer to the substrate than the blue sensitive silver halide emulsion layer but further removed from it than any of the red-sensitive or green-sensitive silver halide emulsion layers; and (d) optionally other layers which are not light-sensitive, characterised in that the silver halide emulsion layers are arranged on the substrate in such a manner that 1. the more sensitive of the two green-sensitive silver halide emulsion layers and the more sensitive of the two red-sensitive silver halide emulsion layers are combined to constitute a comparatively more sensitive emulsion layer unit;
2. the less sensitive of the two green sensitive silver halide emulsion layers and the less sensitive of the two red-sensitive silver halide emulsion layers are combined to constitute a comparatively less sensitive emulsion layer unit; and
3. that silver halide emulsion layer which is closest to the layer substrate within the comparatively more sensitive emulsion layer unit and that silver halide emulsion layer which is furthest removed from the layer substrate within the comparatively less sensitive emulsion layer unit are both sensitive to light of the same spectral region.

On exposure of the colour photographic material according to the invention, the light first passes through the blue sensitive silver halide emulsion layer, then through the comparatively more sensitive emulsion layer unit consisting mainly of the more sensitive green-sensitive silver halide emulsion layer and the more sensitive red-sensitive silver halide emulsion layer, and then reaches the comparatively less sensitive emulsion layer unit, consisting of a less sensitive red sensitive silver halide emulsion layer and a less sensitive green sensitive silver halide emulsion layer.

According to the present invention, the arrangement of red-sensitive and green-sensitive silver halide emulsion layers in the comparatively more sensitive emulsion layer unit is opposite to that found in the comparatively less sensitive emulsion layer unit. This means that if the green-sensitive silver halide emulsion layer is uppermost in the comparatively less sensitive emulsion layer unit, then in the more sensitive emulsion layer unit the green sensitive silver halide emulsion layer is situated lowermost. Since intercoupling between these two partial layers is permissible since they both have the same spectral sensitivity, and give rise to the same partial colour image, there is no need to provide an intermediate layer between them. These two partial layers are therefore advantageously arranged immediately adjacent to each other. This not only simplifies the whole arrangement of layers but also have an advantageous effect on the sharpness and sensitivity without any harmful effect on colour reproduction. According to a preferred embodiment of the invention, the two red-sensitive partial layers are arranged between the more sensitive and the less sensitive of the two green-sensitive silver halide emulsion layers. According to another preferred embodiment, the two green-sensitive partial layers are arranged between the more sensitive and the less sensitive of the two red-sensitive silver halide emulsion layers.

Compared with comparable materials known in the art, in which the cyan partial image and the magenta partial image are also each produced in a plurality of partial layers, the colour photographic material according to the invention shows a marked improvement in sensitivity in the cyan.

The FIGURE shows a sequence of layers according to this invention having a layer support 10 and applied in sequence to this support 10 a less-sensitive green sensitive layer 11, a less-sensitive red sensitive layer 12, a higher sensitive red sensitive layer 13 and a higher sensitive green sensitive layer 14, a yellow filter layer 15 and a blue sensitive layer 16.

In order to obtain a still greater improvement in sensitivity, it is found advantageous if a layer containing comparatively very insensitive and relatively fine grained silver halide is arranged adjacent to one or both light-sensitive silver halide emulsion layers of the comparatively more sensitive emulsion layer unit. Such a layer may be provided in any position within the comparatively more sensitive emulsion layer unit, that is to say above, below, or preferably between the more sensitive red-sensitive and the more sensitive green-sensitive silver halide emulsion layers. The silver halide in these fine grained, relatively insensitive silver halide emulsion layers is preferably silver chloride, silver bromide or mixtures thereof having an average grain size of less than 0.1 $\mu$m.

In the colour photographic recording material according to the invention, two or more blue-sensitive silver halide emulsion layers may be provided in known manner instead of only one blue-sensitive silver halide emulsion layer, but these two layers must always be adjacent to each other.

In addition to the layers already mentioned above, the colour photographic recording material according to the invention may contain auxiliary layers not sensitive to light, e.g. adhesive layers, antihalation layers or covering layers and particularly intermediate layers arranged between the light-sensitive layers, thereby effectively preventing diffusion of developer oxidation products from one layer into another. For this purpose, such intermediate layers may also contain certain compounds capable of reacting with developer oxidation products. These layers are preferably arranged between adjacent light-sensitive layers of different spectral sensitivities.

As already mentioned above, the colour photographic recording material according to the invention contains two light-sensitive partial layers of differing sensitivity for producing each of the partial colour images, at least for producing the cyan and the magenta partial colour image. The sensitivity which has to differ in the two partial layers is not the absolute sensitivity but the effective sensitivity, taking into account the position of the partial layer within the colour photographic multilayered material.

The absolute sensitivity is the sensitivity of an indivi-ual layer if determined separately, that is in absence of other layers. The effective sensitivity of a light sensitive layer within a multilayer colour photographic element may be somewhat lower due to the absorption of certain amounts of exposure light in upper layers. Absolute sensitivity and effective sensitivity refer to the "general sensitivity" which in contrast to the spectral sensitivity may also be called "speed". The difference in effective sensitivity is suitable between 0.2 and 1.0 relative log I.t units. In each individual case, the sensitivity difference is chosen so that colour photographic processing results in a balanced gradation curve without perceptible distortion. The composition of the more highly sensitive layer is suitably calculated to provide a lower colour density on colour development than in the less sensitive layer. This can be achieved by using a smaller quantity of silver and/or a different coupler/silver ratio.

Each of the above mentioned light-sensitive silver halide emulsion layers has a colour coupler associated with it which is capable of reacting with colour developer oxidation products to form a non-diffusible dye. The colour couplers are preferably themselves non-diffusible and accomodated in the light-sensitive layer itself or closely adjacent thereto. The colour couplers associated with the two partial layers of the same spectral sensitivity need not necessarily be identical, provided that, on colour development, they give rise to the same colour, normally one which is complementary to the colour of the light towards which the light sensitive silver halide emulsion layers are sensitive. The red sensitive silver halide emulsion layers therefore have each at least one non-diffusible colour coupler associated with them for producing the cyan partial colour image, generally a coupler based on phenol or α-naphthol. The green sensitive silver halide emulsion layers each contain at least one non-diffusible colour coupler for producing the magenta partial colour image, usually a colour coupler based on 5-pyrazolone or indazolone. The blue sensitive silver halide emulsion layers each contain at least one non-diffusible colour coupler for producing the yellow partial colour image, generally a colour coupler having an open chain keto methylene group. Large numbers of colour couplers of these kinds are known and have been described in numerous patent specifications. Reference to such couplers may be found, for example, in the publication "Farbkuppler" by W. Pelz, in "Mitteilungen aus den Forschungslaboratorien der Agfa, Leverkusen/Munchen", Volume III (1961) page 111 and the publication by K. Venkatataman in "The Chemistry of Synthetic Dyes", Vol. 4, 341 to 387, Academic Press (1971).

The colour couplers used may be either conventional 4-equivalent couplers or they may be 2-equivalent couplers which require a smaller quantity of silver halide for production of the colour. 2-Equivalent couplers are derived, as is known, from 4-equivalent couplers by containing, in the coupling position, a substituent which is split off in the coupling reaction. Suitable 2-equivalent couplers for use in the materials of the present invention include both those which are virtually colourless and those which have an intense colour of their own which disappears during colour coupling or is replaced by the colour of the image dye produced. According to the invention, the last mentioned couplers may also be present in the light-sensitive silver halide emulsion layers where they serve as masking couplers to compensate for the unwanted side densities of the image dyes. Suitable 2-equivalent couplers also include the known white couplers which do not yield a dye in their reaction with colour developer oxidation products and therefore contribute only indirectly to the formation of the colour image. 2-Equivalent couplers also include the known DIR couplers. These are couplers which contain a removable group in the coupling position, this group being liberated as a diffusible silver halide development inhibitor in the reaction with colour developer oxidation products.

Mixtures of colour couplers may be used as desired to obtain the desired colour tone or reactivity. For example, water-soluble couplers may be used in combination with hydrophobic, water-insoluble couplers.

Whereas water-soluble couplers are mainly added to the emulsion in the form of aqueous alkaline solutions, hydrophobic couplers may be incorporated by means of one of the known emulsification processes in which, for example, the coupler may be dissolved in an organic solvent, optionally in the presence of a high boiling coupler solvent, and then dispersed in a gelatine solution. Dibutyl phthalate and tricresyl phosphate are examples of high boiling coupler solvents. Other coupler solvents have been described, for example, in U.S. Pat. Nos. 2,322,027; 3,689,271; 3,764,336 and 3,765,897.

Alternatively, aqueous dispersions of the hydrophobic couplers may be prepared and added to the casting solution. In this case, aqueous suspensions of the couplers are finely milled, for example by vigorous stirring with the addition of sharp sand and/or by application of ultrasound in absence of substantial amounts of organic solvents. References to this subject matter may be found in German Patent Application P 26 09 741.6.

At least one silver halide emulsion layer in the comparatively less sensitive emulsion layer unit suitably contains a non-diffusible compound which is capable of reacting with colour developer oxidation products to release a diffusible development inhibitor. The silver halide emulsion layers of the comparatively more sensitive emulsion layer unit may also, in addition, contain such a non-diffusible compound capable of liberating a diffusible development inhibitor as a result of its reaction with developer oxidation products. These compounds which release development inhibitors include, for example, the known DIR couplers which are colour couplers which carry, in the coupling position, a substituent which is released from the coupler molecule as diffusible development inhibitor in the colour coupling reaction while the coupler molecule becomes a dye. DIR couplers of this kind have been described, for example, in U.S. Pat. No. 3,227,554.

It is particularly preferred, however, to use development inhibitor releasing compounds which react with colour developer oxidation products to release a development inhibitor without at the same time being converted into a dye. Compounds of this kind, which may be referred to as DIR compounds in contrast to DIR couplers, have been described, for example, in U.S. Pat. No. 3,632,345. Reference may also be made in this context to German Offenlegungsschriften No. 2,362,752; 2,539,295; 2,405,442; 2,448,063 and 2,529,350.

The intermediate layers which are arranged between the light-sensitive silver halide emulsion layers, and in which the binder is preferably gelatine, may contain compounds which are capable of reacting with colour developer oxidation products, thus preventing unwanted diffusion of the said oxidation products. Examples of such compounds include non-diffusible reducing agents, e.g. hydroquinone derivatives, or couplers which, when they react with colour developer oxidation products, do not result in a dye which remains in the layers. Particularly suitable among these couplers are the white couplers already mentioned above or also colour couplers which give rise to a soluble dye which is washed out of the layers during the colour photographic process. Other suitable compounds for suppressing unwanted diffusion of colour developer oxidation products have been described, for example, in the monograph entitled "Stabilization of Photographic Silver Halide Emulsions" by E. J. Birr, The Focal Press, 1st Edition 1974, pages 116 to 112.

Information on other suitable additives which may be used in the colour photographic recording material according to the invention or in one of its layers may be found in the article published in the Journal "Product Licensing Index", Volume 92, December 1971, pages 107 to 110.

The photographic materials according to the invention may be developed with the usual colour developer compounds, in particular those based on p-phenylenediamine series which have a primary amino group, e.g. 4-amino-N,N-dimethylaniline, 4-amino-N,N-diethylaniline, 4-amino-3-methyl-N,N-diethyl aniline, 4-amino-3-methyl-N-methyl-N-(β-methylsulphonamidoethyl)-aniline, 4-amino-N-ethyl-N-(β-hydroxyethyl)-aniline, 4-amino-3-methyl-N-ethyl-N-(β-hydroxyethyl)-aniline, 4-amino-3-methyl-N-ethyl-N-(β-methoxyethyl)-aniline, 4-amino-3-methyl-N-ethyl-N-(β-methyl-sulphonamidoethyl)-aniline, 4-amino-N-butyl-N-(ω-sulphobutyl)-aniline and 4-amino-3-methyl-N-isopropyl-N-(ω-sulphobutyl)-aniline.

Other suitable colour developers have been described for example, in J. Amer. Chem. Soc., 73, 3100–3125 (1951).

EXAMPLE 1

Three different layer arrangements were prepared for comparison purposes. In each of these arrangements, the layers described below were applied successively on a transparent substrate provided with an antihalation layer. The quantities indicated refer in each case to 1 $m^2$. The quantities of silver applied are given in terms of silver nitrate.

Arrangement 1 (conventional double layer arrangement)

1. A less sensitive red-sensitive layer containing a red-sensitized silver iodobromide emulsion (5 mol % silver iodide) of 2.4 g of silver nitrate and 630 mg of a cyan coupler of the formula

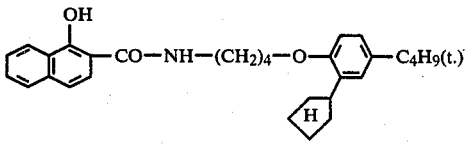

22 mg of a DIR coupler of the formula

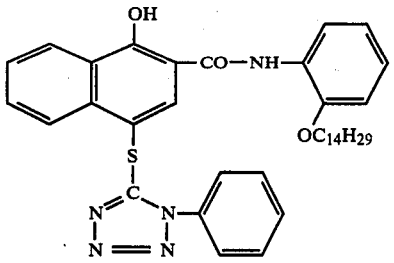

and 1.4 g of gelatine.

2. A more sensitive red-sensitive layer containing a red-sensitized silver iodobromide emulsion (5 mol % of silver iodide) of 2.0 g of silver nitrate containing 250 mg of the cyan coupler of layer 1.
3. An intermediate layer of 0.7 g of gelatine.
4. A less sensitive green-sensitive layer containing a green-sensitized mixture of a relatively sensitive silver iodobromide emulsion (5 mol % silver iodide) of 1.5 g of silver nitrate and a relatively insensitive silver iodobromide emulsion (5 mol % silver iodide) of 1.9 g of silver nitrate and 550 mg of a magenta coupler of the formula

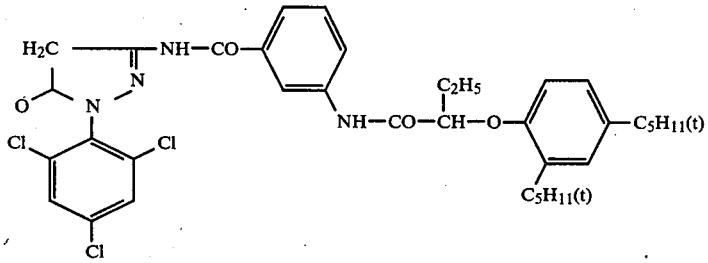

55 mg of a DIR coupler of the formula

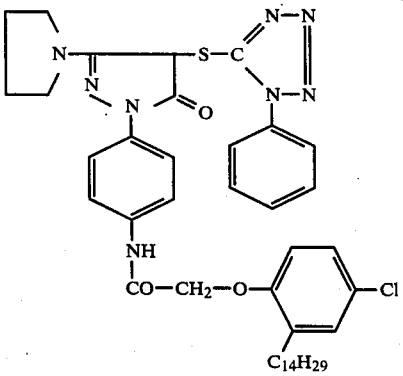

73 mg of a masking coupler of the formula

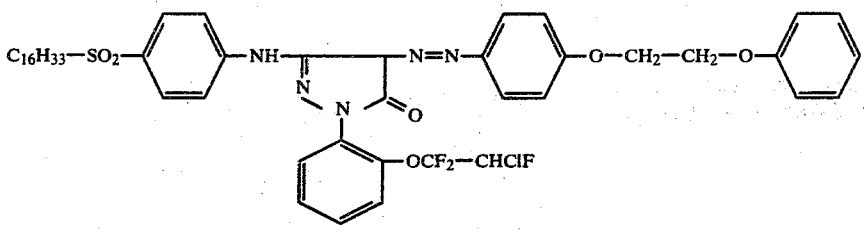

and 1.8 g of gelatine.

5. A more sensitive green-sensitive layer containing a green sensitized silver iodobromide emulsion (7 mol % silver iodide) of 2.8 g of silver nitrate and 170 mg of a magenta coupler of the formula

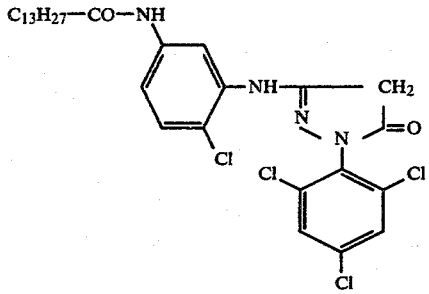

37 mg of a magenta coupler of the formula

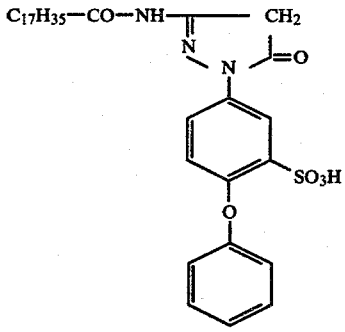

and 2.1 g of gelatine.

6. An intermediate layer containing 0.7 g of gelatine.
7. A yellow filter layer containing colloidal silver to obtain a yellow density of 0.8.
8. A blue-sensitive layer containing a mixture of a relatively sensitive silver iodobromide emulsion (9 mol % silver iodide) of 1.0 g of silver nitrate and a relatively insensitive silver iodobromide emulsion (1 mol % silver iodide) of 0.56 of silver nitrate with 1.5 g of a yellow coupler of the formula

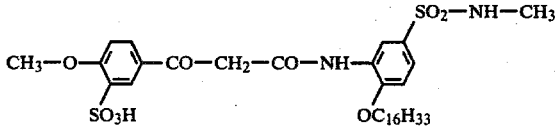

and 2.0 g of gelatine.

9. A covering layer of 0.7 g of gelatine.

Arrangement 2 (according to the invention)

The same layers having the same compositions are used as in arrangement 1 but in a different sequence. The number in brackets indicates in each case the corresponding layer in Arrangement 1.

1. Less sensitive green-sensitive layer (4)
2. Intermediate layer containing 0.7 g of gelatine
3. Less sensitive red-sensitive layer (1)
4. More sensitive red-sensitive layer (2)
5. Intermediate layer containing 0.7 g of gelatine
6. More sensitive green-sensitive layer (5)
7. Intermediate layer of 0.7 g of gelatine
8. Yellow filter layer (7)
9. Blue-sensitive layer (8)
10. Covering layer (9).

Arrangement 3 (corresponding to German Offenlegungsschrift No. 2,530,645)

The same layers having the same compositions as in Arrangement 1 are applied in the following sequence:

1. Less sensitive red sensitive layer (1)
2. Intermediate layer of 0.7 g of gelatine
3. Less sensitive green-sensitive layer (4)
4. Intermediate layer of 0.7 g of gelatine
5. More sensitive red sensitive layer (2)
6. Intermediate layer of 0.7 g of gelatine
7. More sensitive green-sensitive layer (5)
8. Intermediate layer of 0.7 g of gelatine
9. Yellow filter layer (7)
10. Blue-sensitive layer (8)
11. Covering layer (9).

The three different arrangements were subjected to a colour photographic process as described in The British Journal of Photography, July 1974, pages 597 to 598. The sensitivities obtained, determined at density 0.2 above fog, are shown in the following Table.

Table

| Arrangement | Sensitivity [rel. log I . t] Yellow | Magenta | Cyan |
|---|---|---|---|
| 1 | 4.19 | 3.89 | 3.64 |
| 2 | 4.21 | 3.89 | 3.80 |
| 3 | 4.23 | 3.87 | 3.73 |

The figures show that the cyan sensitivity is highest in Arrangement 2 according to the invention. Compared with Arrangement 1, this gain in cyan sensitivity is due to the favourable position of the more sensitive cyan partial layer within the layers whereas compared with Arrangement 3 the gain in cyan sensitivity is due to the increased gradation which in turn is due to the interaction between the immediately adjacent cyan partial layers in Arrangement 2 according to the invention. This is achieved at the expense of only one additional intermediate layer compared with the conventional double layered arrangement (Arrangement 1). Compared with Arrangement 3 (according to German Offenlegungsschrift No. 2,530,645), the photographic material according to the invention has one layer less in spite of its higher cyan sensitivity.

EXAMPLE 2

Two layer arrangements comprising the same layers having the same compositions as in Example 1 were compared. The number in brackets indicates in each case the corresponding layer in Arrangement 1 of Example 1.

Arrangement 1

Corresponds to Arrangement 3 of Example 1.

Arrangement 2

1. Less sensitive red-sensitive layer (1)
2. Intermediate layer of 0.7 g of gelatine
3. Less sensitive green-sensitive layer (4)
4. More sensitive green-sensitive layer (5)
5. Intermediate layer of 0.7 g of gelatine
6. More sensitive red-sensitive layer (2)
7. Intermediate layer of 0.7 g of gelatine
8. Yellow filter layer (7)
9. Blue sensitive layer (8)
10. Covering layer (9)

The following results were obtained:

Table 2

| | Sensitivity [rel. log I.t] | | |
|---|---|---|---|
| | Yellow | Magenta | Cyan |
| Arrangement 1 | 4.30 | 3.81 | 3.96 |
| Arrangement 2 | 4.30 | 3.80 | 4.09 |

The more favourable position of the red-sensitive layer within the more sensitive unit in Arrangement 2 thus results in a marked improvement in the cyan sensitivity while the magenta sensitivity is not significantly reduced. The loss in sensitivity resulting from the more unfavourable position of the more sensitive green sensitive partial layer in Arrangement 2 is obviously compensated for by the interaction with the less sensitive green sensitive partial layer, and the resulting increase in gradation.

We claim:

1. The color photographic recording material consisting of (a) a layer support having applied to it a plurality of light-sensitive and non-light-sensitive layers including (b) at least two red sensitive silver halide emulsion layers of different speed each having associated with it a non-diffusing cyan-forming coupler, at least two green sensitive silver halide emulsion layers of different speed each having associated with it a non-diffusing magenta-forming coupler, and one or more blue sensitive silver halide emulsion layers each of said one or more blue sensitive layers having associated with it a non-diffusing yellow-forming coupler, and being located further removed from the layer support than anyone of said red sensitive and green sensitive layers, and (c) at least one non-light-sensitive yellow filter layer located closer to the layer support than any of said one or more blue sensitive layers, the more sensitive of said red sensitive layers and the more sensitive of said green sensitive layers being combined to form a comparatively more sensitive emulsion layer unit which is located further removed from the layer support than the less sensitive of said red sensitive layers and the less sensitive of said green sensitive layers, which are combined to form a comparatively less sensitive emulsion layer unit and so that the photographic material contains at least two emulsion layers of the red spectral region and at least two emulsion layers of the green spectral region wherein the improvement comprises a combination of the less sensitive and the more sensitive of the partial layers of a same spectral region are directly adjacent to each other without an intermediate layer, and the combination is arranged between the more sensitive and less sensitive of the partial layers of the other spectral region, so that the directly adjacent partial layers having the same spectral sensitivity permit intercoupling between the two partial layers.

2. Photographic material as claimed in claim 1, in which the less sensitive and the more sensitive of the two red-sensitive silver halide emulsion layers are combined to constitute a red-sensitive emulsion layer unit which is arranged between the more sensitive and the less sensitive of the two green sensitive silver halide emulsion layers.

3. Photographic material as claimed in claim 1, in which the less sensitive and the more sensitive of the two green-sensitive silver halide emulsion layers are combined to constitute a green sensitive emulsion layer unit which is arranged between the more sensitive and the less sensitive of the two red-sensitive silver halide emulsion layers.

4. Photographic material as claimed in claim 1, in which at least one silver halide emulsion layer in the comparatively less sensitive emulsion layer unit contains a non-diffusing compound which is capable of reacting with color developer oxidation products to release a diffusible development inhibitor.

* * * * *